US008579677B2

(12) United States Patent
Boudreau

(10) Patent No.: US 8,579,677 B2
(45) Date of Patent: Nov. 12, 2013

(54) ABRASIVE IMPREGNATED BRUSH

(75) Inventor: Trinity J. Boudreau, Worcester, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 168 days.

(21) Appl. No.: 13/233,784

(22) Filed: Sep. 15, 2011

(65) Prior Publication Data

US 2012/0071071 A1 Mar. 22, 2012

Related U.S. Application Data

(60) Provisional application No. 61/383,027, filed on Sep. 15, 2010.

(51) Int. Cl.
*B24B 1/00* (2006.01)

(52) U.S. Cl.
USPC ..... 451/28; 451/466; 451/526; 451/536; 451/532; 51/309

(58) Field of Classification Search
USPC ..... 451/526–539, 466; 51/309
See application file for complete search history.

(56) References Cited

U.S. PATENT DOCUMENTS

| | | | |
|---|---|---|---|
| 3,522,342 | A | 7/1970 | Nungesser et al. |
| 4,623,364 | A | 11/1986 | Cottringer et al. |
| 4,646,479 | A | 3/1987 | Walker et al. |
| 5,016,311 | A | 5/1991 | Young et al. |
| 5,083,840 | A | 1/1992 | Young et al. |
| 5,129,197 | A | 7/1992 | Tyler et al. |
| 5,155,945 | A | 10/1992 | Tyler et al. |
| 5,170,593 | A | 12/1992 | Tyler et al. |
| 5,187,904 | A | 2/1993 | Tyler et al. |
| 5,233,719 | A | 8/1993 | Young et al. |
| 5,279,079 | A | 1/1994 | Tyler et al. |
| 5,284,039 | A | 2/1994 | Torgerson |
| 5,295,332 | A | 3/1994 | Tyler et al. |
| 5,318,603 | A | 6/1994 | Scheider et al. |
| 5,329,730 | A | 7/1994 | Scheider et al. |
| 5,400,458 | A | 3/1995 | Rambosek |
| 5,423,718 | A | 6/1995 | Tyler et al. |
| 5,427,595 | A | 6/1995 | Pihl et al. |
| 5,438,728 | A | 8/1995 | Kubes et al. |
| 5,443,418 | A | 8/1995 | Frodin et al. |

(Continued)

FOREIGN PATENT DOCUMENTS

WO 2012/037386 A2 3/2012

OTHER PUBLICATIONS

Search Results, Thompson Innovation, Jan. 12, 2010, 62 pages.
PCT ISR dated Apr. 27, 2012.

*Primary Examiner* — George Nguyen
(74) *Attorney, Agent, or Firm* — Joseph P. Sullivan; Abel Law Group, LLP

(57) ABSTRACT

An abrasive brush includes a securing element and a plurality of abrasive filaments secured to the securing element to form a brush. Each abrasive filament includes a matrix of thermoplastic polymer and a plurality of alumina abrasive particles interspersed throughout at least a portion of the matrix. The abrasive particles comprising a polycrystalline alpha alumina having a fine crystalline microstructure characterized by an alpha alumina average domain size not greater than 500 nm. The alumina abrasive particles further include a pinning agent comprising a dispersed phase in the polycrystalline alpha alumina.

17 Claims, 1 Drawing Sheet

(56) References Cited

U.S. PATENT DOCUMENTS

| | | | |
|---|---|---|---|
| 5,443,906 | A | 8/1995 | Pihl et al. |
| 5,491,025 | A | 2/1996 | Pihl et al. |
| D369,447 | S | 4/1996 | Mann et al. |
| 5,518,794 | A | 5/1996 | Barber, Jr. et al. |
| 5,556,328 | A | 9/1996 | Scheider et al. |
| 5,588,172 | A | 12/1996 | Biocca |
| 5,605,383 | A | 2/1997 | Biocca |
| 5,737,794 | A | 4/1998 | Barber, Jr. et al. |
| 5,815,876 | A | 10/1998 | Overseth |
| 5,837,179 | A | 11/1998 | Pihl et al. |
| 5,860,184 | A | 1/1999 | Platzer et al. |
| 5,895,612 | A | 4/1999 | Warner et al. |
| 5,903,951 | A | 5/1999 | Ionta et al. |
| 5,928,589 | A | 7/1999 | Norota et al. |
| 6,269,514 | B1 | 8/2001 | Edwards et al. |
| 6,312,323 | B1 | 11/2001 | Warner et al. |
| 6,352,471 | B1 | 3/2002 | Bange et al. |
| 6,422,932 | B1 | 7/2002 | Lageson et al. |
| 6,431,971 | B2 | 8/2002 | Nagafuchi |
| 6,434,778 | B1 | 8/2002 | Edwards et al. |
| 6,475,253 | B2 | 11/2002 | Culler et al. |
| 6,539,574 | B2 | 4/2003 | Payne et al. |
| 6,564,417 | B2 | 5/2003 | Porat |
| 6,730,140 | B2 | 5/2004 | Lageson et al. |
| 6,860,912 | B2 | 3/2005 | Krupnick |
| D569,403 | S | 5/2008 | Uetani |
| 7,530,540 | B2 | 5/2009 | Long et al. |
| 2002/0132572 | A1 | 9/2002 | Lageson et al. |
| 2004/0148866 | A1 | 8/2004 | Krupnick |
| 2004/0185762 | A1 | 9/2004 | Turch et al. |
| 2008/0148653 | A1 | 6/2008 | Bauer et al. |
| 2008/0280541 | A1 | 11/2008 | Chou et al. |
| 2009/0075547 | A1 | 3/2009 | Rotter |
| 2009/0191798 | A1 | 7/2009 | Koh |

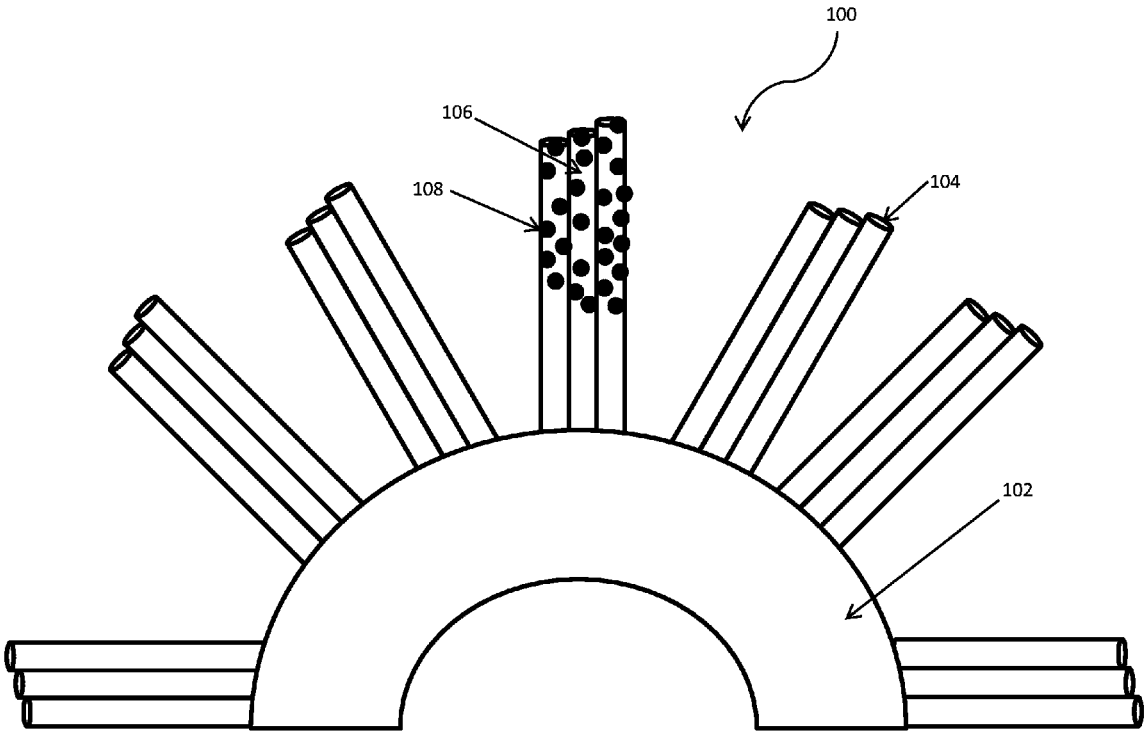
100
106
108
104
102

ABRASIVE IMPREGNATED BRUSH

CROSS-REFERENCE TO RELATED APPLICATION(S)

The present application claims priority from U.S. Provisional Patent Application No. 61/383,027, filed Sep. 15, 2010, entitled "Abrasive Impregnated Brush," naming inventor Trinity J. Boudreau, which application is incorporated by reference herein in its entirety.

FIELD OF THE DISCLOSURE

The present disclosure generally relates to an abrasive impregnated brush.

BACKGROUND

Abrasive materials and components have long been used in various industrial-machining applications, including lapping/grinding, in which bulk material removal is executed, to fine polishing, in which fine micron and submicron surface irregularities are addressed. Typical materials that undergo such machining operations include various ceramics, glasses, glass-ceramics, metals and metal alloys. Abrasives may take on any one of various forms, such as free abrasives as in an abrasive slurry in which loose abrasive particles in suspension are used for machining. Alternatively, abrasives may take the form of a fixed abrasive, such as a coated abrasive or a bonded abrasive. Coated abrasives are generally categorized as abrasive components having an underlying substrate, on which abrasive grits or grains are adhered thereto through a series of make coats and size coats. Bonded abrasives typically do not have an underlying substrate and are formed of an integral structure of abrasive grits that are bonded together via a matrix bonding material.

Abrasive brushes can include a plurality of abrasive filaments. The abrasive filaments can include a matrix material, such as a polymer. Further, abrasive grits can be dispersed within the polymer matrix. Advantageously, the flexible filaments enable the abrasive brush to conform to the surface features of a work piece to polish an irregularly shaped surface. A need continues to exist in the art for abrasive brushes with improved performance and durability.

SUMMARY

In an embodiment, an abrasive brush can include a securing element, and a plurality of abrasive filaments secured to the securing element to form a brush. Each abrasive filament can include a matrix of thermoplastic polymer and a plurality of alumina abrasive particles interspersed throughout at least a portion of the matrix. The abrasive particles can include a polycrystalline alpha alumina having a fine crystalline microstructure characterized by an alpha alumina average domain size not greater than 500 nm. The alumina abrasive particles can further include a pinning agent as a dispersed phase in the polycrystalline alpha alumina.

In another embodiment, an abrasive brush can include a securing element and a plurality of abrasive filaments secured to the securing element to form a brush. Each abrasive filament can include a matrix of thermoplastic polymer and a plurality of abrasive particles interspersed throughout at least a portion of the matrix. In a particular embodiment, the abrasive brush can have a Wear Rating of at least 1.4. In another particular embodiment, the abrasive brush can have a Material Removal Rating of at least 1.4. In a further particular embodiment, the can have a High Pressure Material Removal Rating is at least 1.4. In still another particular embodiment, the abrasive brush can have a Low Pressure Material Removal Rating of at least 1.4.

In a yet another embodiment, a method of forming an abrasive brush can include combining a thermoplastic polymer with a plurality of abrasive particles into a mixture, and extruding the mixture to form an abrasive filament. The abrasive particles can include a polycrystalline alpha alumina having a fine crystalline microstructure characterized by an alpha alumina average domain size not greater than 500 nm. The alumina abrasive particles can further include a pinning agent comprising a dispersed phase in the polycrystalline alpha alumina. The method can further include securing the abrasive filament to a securing element to form the abrasive brush.

In a further embodiment, a method can include providing a work piece and abrading the surface of the work piece with an abrasive brush. The abrasive brush can include a securing element and a plurality of abrasive filaments secured to the securing element to form a brush. Each abrasive filament can include a matrix of thermoplastic polymer and a plurality of abrasive particles interspersed throughout at least a portion of the matrix. The abrasive brush can have a Wear Rating is at least 1.2.

BRIEF DESCRIPTION OF THE DRAWINGS

The present disclosure may be better understood, and its numerous features and advantages made apparent to those skilled in the art by referencing the accompanying drawings.

FIG. 1 is a diagram illustrating an exemplary abrasive brush.

The use of the same reference symbols in different drawings indicates similar or identical items.

DETAILED DESCRIPTION

In an embodiment, an abrasive brush can include a securing element, and a plurality of abrasive filaments secured to the securing element to form a brush. Each abrasive filament can include a matrix of thermoplastic polymer and a plurality of alumina abrasive particles interspersed throughout at least a portion of the matrix.

FIG. 1 illustrates an exemplary abrasive brush 100. The abrasive brush 100 can include a securing element 102 and a plurality of abrasive filaments 104. The securing element 102 can include a metal, a polymer, a composite, or any combination thereof. In a particular embodiment, the securing element can be a hub or wheel, such as for securing the abrasive brush 100 to a rotary motor. The hub or wheel may be a single piece or multi-piece, such as two-piece, three-piece, or more. In a particular embodiment, the hub is a single piece, i.e., unitary, polymer hub. In an alternate embodiment, the securing element can be a portion of a handle for a handheld abrasive brush.

The abrasive filaments 104 can include a matrix material 106, such as a polymer. In an embodiment, the polymer can be a thermoplastic polymer, such as a polyimide, i.e., a nylon, a polyester, a polyethylene, a polypropylene, combinations thereof, and the like. Additionally, the abrasive filaments can include abrasive particles 108 dispersed within at least a portion of the matrix material 106. For example, the abrasive particles 108 can be dispersed substantially throughout the abrasive filament 104, or can be dispersed primarily within an outer layer of the matrix material 106. The abrasive particles may be completely submerged within, partially exposed through, or fully exposed through the surface of the matrix material or some combination thereof. In an alternative embodiment, the abrasive particles 108 can be bonded to the surface of the abrasive filaments 104.

In an embodiment, the polymer matrix 106 can be present in an amount of 90 wt % to about 50 wt % of the abrasive filaments. The abrasive particles 108 can be present in the abrasive filaments in an amount of 10 wt % to about 50 wt %. In a particular embodiment, the polymer matrix 106 can be present in an amount of 80 wt % to about 60 wt %, even in an amount of 85 wt % to about 65 wt % of the abrasive filaments, and the abrasive particles 108 can be present in an amount of 20 wt % to about 40 wt %, even in an amount of 25 wt % to about 35 wt %.

The abrasive particles 108 can be an alumina abrasive grit. Typically the alumina abrasive grits are principally formed of polycrystalline α-alumina. The polycrystalline α-alumina generally forms the majority phase of the grits, that is, at least 50% by weight of the grit. However, generally, the alumina abrasive grits are at least 60 wt. %, oftentimes at least 80 wt. %, and in certain embodiments at least 90 wt. % polycrystalline α-alumina. The polycrystalline α-alumina has a fine crystalline microstructure that may be characterized by an α-alumina average domain size not greater than 500 nm. The crystalline domains of the α-alumina are discrete, identifiable crystalline regions of the microstructure that are formed of an aggregation of single crystals, or may be formed of a single crystal. However, according to certain embodiments, the crystalline domains are monocrystalline and are easily observed through scanning electron microscopy analysis. The crystalline domain size may be even finer, such as not greater than 400 nm, or not greater than 300 nm. With the even finer crystal domain size, typically the domains are single crystalline as noted above. Such fine domains may be particularly small, such as not greater than 200 nm, not greater than 190 nm, or even not greater than 180 nm. It is noteworthy that the fine crystalline domain size can be present in a high temperature bonded polycrystalline α-alumina abrasive component, or grit, post-processing. Being able to maintain such fine crystalline domain size is particularly noteworthy, because the process for forming the high temperature bonded abrasive grit oftentimes involves high temperature treatment to cure the vitreous bond matrix of the grit and such high temperature treatment has a tendency to cause exaggerated domain growth, which is particularly undesirable. Further details are provided below.

The alumina abrasive grits further include a pinning agent. A pinning agent is a material that is foreign to the α-alumina microstructure of the grits, and can be identified by a second phase dispersed in the polycrystalline α-alumina matrix phase. The pinning agent is generally effective to "pin" the domains, thereby preventing exaggerated domain growth during sintering and/or high temperature processing of the grits to form the bonded abrasive component. Examples of a pinning agent include oxides, carbides, nitrides and borides, as well as reaction products thereof with the polycrystalline α-alumina matrix. According to particular embodiments, the pinning agent comprises an oxide of at least one of silicon, boron, titanium, zirconium, and a rare-earth element, and reaction products thereof with the polycrystalline α-alumina matrix. A particular pinning agent is zirconium oxide, generally in the form of $ZrO_2$ (zirconia). Zirconium oxide is particularly suitable material and generally is inert within the polycrystalline α-alumina matrix, so as to undergo very limited reaction with the α-alumina, thereby retaining a zirconium oxide crystal phase, typically zirconia. The pinning agent is generally present in the alumina abrasive grits in an amount not less than about 0.1 wt. %, such as an amount not less than about 0.5 wt. %, or not less than about 1.0 wt. %. The lower limit of the pinning agent is chosen to be an amount that is effective to prevent exaggerated domain growth.

According to one embodiment, the pinning agent is present in the abrasive grits in an amount not greater than 40 wt. %, such as an amount not greater than 30 wt. %, not greater than 20 wt. % or even not greater than 10 wt. % of the abrasive grit. In the high temperature bonded abrasive, the pinning agent is generally identified as having a particulate size not greater than 5 microns, such as not greater than 1 micron. Fine particulate sizes associated with the pinning agent have been found to be useful, such as not greater than 500 nm, or not greater than 300 nm, or not greater than 200 nm. As described in more detail below, in the context of methods for forming high temperature bonded abrasive components, the pinning agent may be introduced into the alumina abrasive grits in solid form, such as in sub-micron form, particularly including colloidal form. Alternatively, the pinning agent, or a precursor thereof, may be introduced into the alumina abrasive grits, such that upon high temperature heat treatment the pinning agent, or precursor thereof, converts into a desired crystalline phase such as the desired oxide, carbide, nitride, or boride.

Processing to form an abrasive brush according to embodiments of the present invention generally begins with the formation of the abrasive particles, such as alumina abrasive grits. According to a particular embodiment, the alumina abrasive grits are formed through a seeded process, in which an appropriate seeding material is combined with an α-alumina precursor, followed by heat treatment to convert the α-alumina precursor into the desired α-alumina phase. The seeds may be formed in accordance with U.S. Pat. No. 4,623,364, in which seeded gel alumina dried precursor is calcined to form α-alumina. The calcined α-alumina may be further processed such as by milling to provide an appropriate high-surface area seed material. Typically, the surface area is quantified by specific surface area (SSA). Surface area is typically not less than 10 $m^2/g$, such as, not less than 20 $m^2/g$, not less than 30 $m^2/g$, or not less than 40 $m^2/g$. Particular embodiments have a surface area not less than 50 $m^2/g$. Generally, the surface area is limited, such as not greater than 300 $m^2/g$, such as not greater than 250 $m^2/g$.

The seed material is then combined with the α-alumina precursor, which may take on any one of several forms of aluminous materials that is an appropriate form for conversion to α-alumina. Such precursor materials include, for example, hydrated aluminas, including alumina trihydrate (ATH) and boehmite. As used herein, boehmite denotes alumina hydrates including mineral boehmite, typically being $Al_2O_3 \cdot H_2O$ and having a water content on the order of 15%, as well as pseudo-boehmite, having a water content greater than 15%, such as 20% to 38%. As such, the term boehmite will be used to denote alumina hydrates having 15 to 38% water content, such as 15 to 30% water content by weight. It is noted that boehmite, including pseudo-boehmite, has a particular and identifiable crystal structure and accordingly, a unique X-ray diffraction pattern, and as such, is distinguished from other aluminous materials, including other hydrated aluminas.

Typically, the α-alumina precursor, such as boehmite, is combined with the seeded material such that the seeds are present in an amount not less than 0.2 wt. % with respect to total solids content of seeds and α-alumina precursor. Typically, the seeds are present in an amount less than 30 wt. %, or, typically, in an amount not greater than 20 wt. %.

The seeds and the α-alumina precursor are generally combined in slurry form, which is then gelled, such as by the addition of an appropriate acid or base, such as nitric acid. Following gelation, the gel is typically dried, crushed, and dried material is passed through classification sieves. The classified solid fraction may then be subjected to a sintering process that has limited heat soak time. Typically, sintering is carried out for a time period not exceeding 30 minutes, such as not greater than 20 minutes, or not greater than 15 minutes. According to particular embodiments, the sintering period is particularly short, such as not greater than 10 minutes.

According to a particular development, a pinning agent or pinning agent precursor is added to the suspension containing seeds and α-alumina precursor. Typically, the pinning agent or pinning agent precursor is present in an amount not greater than 40 wt. % based upon the combined solids content of the α-alumina precursor, seeds, and pinning agent or pinning agent precursor (calculated based upon solids content of the pinning agent in the final α-alumina grit). Generally, the pinning agent is present in an amount not less than 0.1 wt. %, such as not less than about 0.5 wt. %, or even not less than about 1 wt. %, based upon the total solids content as noted above.

Still further, according to a particular development, sintering is carried out at a temperature above the temperature that is necessary to effect conversion of the α-alumina precursor into α-alumina. In a sense, certain embodiments call for "over-sintering" the α-alumina precursor material. Particularly suitable temperatures are generally not less than 1350° C., such as not less than 1375° C., not less than 1385° C., not less than 1395° C., or not less than 1400° C. In this respect, it is noted that while fine microstructured seeded α-alumina materials have been formed in the art, typically such materials are processed at lower temperatures, oftentimes below 1350° C., such as on the order of 1300° C. Further observations on the combined effect of utilization of a pinning agent and over-sintering are provided herein below.

Following sintering the abrasive particles may, optionally, be classified, such as by sizing and sorting of the abrasive particles. The abrasive particles are then combined with a matrix material and extruded to form the abrasive filaments. In an embodiment, a thermoplastic polymer, such as a nylon, a polyester, or another suitable thermoplastic, can be combined with a plurality of abrasive particles. For example, the thermoplastic polymer can be melted and the abrasive particles can be dispersed throughout the molten thermoplastic polymer, such as by compounding. The mixture of the molten thermoplastic and the abrasive particles can be extruded to form an abrasive filament.

The abrasive filaments can be secured to a securing element to form the abrasive brush. In an embodiment, the abrasive filaments can be bonded to the securing element using an adhesive. In another embodiment, the abrasive filaments can be threaded through a portion of the securing element. For example, the abrasive filaments can be looped through the securing element to hold them in place. In yet another embodiment, the securing element can be formed around the abrasive filaments. For example, the abrasive filaments can be placed in a mold and a polymer can be added to the mold. The polymer can cure or set to form the securing element and bond the filaments in place.

The abrasive brush can be used for deburring, polishing a work piece, or other surface conditioning of a work piece. The work piece can include a ceramic, a metal or metal alloy, a polymer, a composite, including an advanced composite, an organic material, such as wood, another suitable material, or any combination thereof. The metal or metal alloy can include a ferrous metal, including a carbon steel, a non-ferrous metal, a super alloy, a powdered metal, or any combination thereof. For example, the metal or metal alloy can include a wear resistant coating, such as a thermal spray coating, or a high velocity oxidized fuel coating. Further, the work piece can be formed by casting, machining, or another forming process. In an embodiment, the abrasive brush can be rotated at high speed against the work piece, either by forcing the abrasive brush against the work piece, by forcing the work piece against the abrasive brush, or combinations thereof. The force and rotation speed of the brush can be varied according to the needs of the desired application.

Advantageously, the abrasive brush can have an improved performance and working life. For example, the abrasive brush can have an improved material removal. The material removal rate is the amount of material removed from the work piece when abraded for a specified amount of time. Specifically, the Material Removal Rating is defined as the ratio of the material removal rate for the abrasive brush to the material removal rate for a similar abrasive brush that includes primarily silicon carbide as the abrasive particles. The Material Removal Rating can be at least 1.2, such as at least 1.35, even at least 1.5. The abrasive brush can exhibit similarly improved performance under both high and low abrasive pressures. The abrasive brush can have a High Pressure Material Removal Rating, defined as the Material Removal Rating when a workpiece has a plunge depth of 0.150 inches into the spinning abrasive brush, of at least 1.3, such as at least 1.45, even at least 1.6. Similarly, the abrasive brush can have a Low Pressure Material Removal Rating, defined as the Material Removal Rating measured using a workpiece plunge depth of 0.100 inches into the spinning abrasive brush, of at least 1.1, such as at least 1.3, even at least 1.6.

Further, the abrasive brush can have an increased G-ratio. The G-ratio is defined as the ratio of the material removed from the work piece to the material lost from the brush. Specifically, the abrasive brush can have a Wear Rating of at least 1.2, such as at least 1.35, even at least 1.5, wherein the Wear Rating is the ratio of the G-ratio of the abrasive brush to the G-ratio of an abrasive brush that includes primarily silicon carbide abrasive particles.

EXAMPLES

Sample brushes are tested to determine the material removal rate and G-ratio. Sample brushes are dressed and rotated to a surface speed of 3172 SFPM and work pieces were repeatedly plunged into the rotating brush at a rate of 41 pieces per minute. During an initial dressing stage, carbide work pieces are used for 15 minutes. During a first testing stage, test work pieces are plunged into the rotating brush to a depth of 0.100 inches (i.e., low pressure application) for 30 minutes. During a second testing stage, test work pieces are plunged into the rotating brush to a depth of 0.100 inches for 30 minutes. During a third testing stage, test work pieces are plunged into the rotating brush to a depth of 0.150 inches (i.e., high pressure application) for 30 minutes. Six test work pieces of 0.5 in×0.5 in 304 stainless steel bars are used per sample brush. The test work pieces and sample brushes are weighed and the surface finish recorded before and after each testing stage.

Sample 1 is an 11 inch diameter, 1 inch wide brush having filament length of 3 inches. The filament is a 40 mil diameter filament including 30 wt % 120 grit black silicon carbide abrasive grain (commercially available from AGSCO Corporation of Hasbrouck Heights, N.J. or Washington Mills Electro Minerals of Niagara Falls, N.Y.) and 70 wt % 612 nylon (commercially available from DuPont Filaments—Americas LLC, of Wilmington, Del.).

Sample 2 is prepared as sample 1 except the abrasive grain is a 120 grit $Al_2O_3$ abrasive grain (commercially available from Saint-Gobain) having a density of 3.86-3.95 g/cm3 and a hardness of 20.4-22.9 GPa.

Sample 3 is prepared as Sample 1 except the abrasive grain is a 120 grit alumina abrasive grit with a pinning agent. The abrasive grit was prepared by combining alpha alumina seeds, alumina precursor material (DISPERAL commercially available from Sasol, Inc of Hamburg, Germany), zirconia (NYACOL 20 nm colloidal ZrO2 acetate stabilized form from Nyacol), and magnesium nitrate in sufficient quantities to achieve a final composition of at least about 96% alumina, about 2.4% zirconia, and about 1.0% magnesia. Nitric acid is added with continued stirring to form a gel. The gel is dried overnight and crushed. The grit is sintered at 1400° C. for 5 minutes.

Sample 4 is prepared as Sample 1 except the abrasive grain is a 150 grit alumina abrasive grit with a pinning agent prepared as described in Sample 3.

Tables 1 and 2 show the results of testing.

TABLE 1

| | Material Removal Rate (g) @ plunge depth 0.100 in | Material Removal Rate in (g) @ plunge depth of 0.150 in | Material Removal Rate Avg. (g) | G-Ratio |
|---|---|---|---|---|
| Sample 1 | 0.010 | 0.017 | 0.012 | 0.059 |
| Sample 2 | 0.010 | 0.020 | 0.013 | 0.061 |
| Sample 3 | 0.017 | 0.027 | 0.020 | 0.092 |
| Sample 4 | 0.017 | 0.030 | 0.021 | 0.098 |

TABLE 2

| | Low Pressure Material Removal Rating | High Pressure Material Removal Rating | Material Removal Rating | Wear Rating |
|---|---|---|---|---|
| Sample 1 | 1.00 | 1.00 | 1.00 | 1.00 |
| Sample 2 | 1.00 | 1.18 | 1.08 | 1.03 |
| Sample 3 | 1.70 | 1.59 | 1.67 | 1.56 |
| Sample 4 | 1.70 | 1.76 | 1.75 | 1.66 |

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive brush comprising:

a securing element; and a plurality of abrasive filaments secured to the securing element to form a brush, each abrasive filament comprising a matrix of thermoplastic polymer and a plurality of alumina abrasive particles interspersed throughout at least a portion of the matrix, the abrasive particles comprising a polycrystalline alpha alumina having a fine crystalline microstructure characterized by an alpha alumina average domain size not greater than 500 nm, wherein the alumina abrasive particles further comprising a pinning agent, the pinning agent comprising a dispersed phase in the polycrystalline alpha alumina, wherein the polycrystalline alpha alumina is in an amount of at least 80 wt %, and wherein the pinning agent is present in the abrasive particles in an amount not less than about 0.1 wt % and not greater than 20 wt %.

2. The abrasive brush of claim 1, wherein the thermoplastic polymer includes a polyester, a polyimide, or any combination thereof.

3. The abrasive brush of claim 1, wherein the pinning agent comprises an oxide of at least one of silicon, boron, titanium, zirconium, and a rare earth element, and the reaction products thereof with the polycrystalline alpha alumina matrix.

4. The abrasive brush of claim 1, wherein the abrasive brush has a Wear Rating of at least 1.2.

5. The abrasive brush of claim 4, wherein the Wear Rating is at least 1.35.

6. The abrasive brush of claim 1, wherein the abrasive brush has a Material Removal Rating is at least 1.2.

7. The abrasive brush of claim 6, wherein the Material Removal Rating is at least 1.35.

8. The abrasive brush of claim 1, wherein the abrasive brush has a High Pressure Material Removal Rating is at least 1.3.

9. The abrasive brush of claim 8, wherein the High Pressure Material Removal Rating is at least 1.45.

10. The abrasive brush of claim 1, wherein the abrasive brush has a Low Pressure Material Removal Rating is at least 1.1.

11. The abrasive brush of claim 1, wherein the abrasive particles are present in the abrasive filaments in an amount of 10 wt % to about 50 wt %.

12. The abrasive brush of claim 1, wherein the polymer matrix is present in the abrasive filaments in an amount of 90 wt % to about 50 wt %.

13. A method of forming an abrasive brush, comprising:

combining a thermoplastic polymer with a plurality of abrasive particles into a mixture, the abrasive particles comprising a polycrystalline alpha alumina having a fine crystalline microstructure characterized by an alpha alumina average domain size not greater than 500 nm, wherein the alumina abrasive particles further comprising a pinning agent, the pinning agent comprising a dispersed phase in the polycrystalline alpha alumina;

extruding the mixture to form an abrasive filament;

securing the abrasive filament to a securing element to form the abrasive brush, wherein the polycrystalline alpha alumina is present in the abrasive particles in an amount of at least 80 wt %, wherein the pinning agent is present in the abrasive particles in an amount not less than about 0.1 wt % and not greater than 20 wt %.

14. The method of claim 13, wherein the abrasive particles are present in the abrasive filaments in an amount of 10 wt % to about 50 wt %.

15. The method of claim 13, wherein the polymer matrix is present in the abrasive filaments in an amount of 90 wt % to about 50 wt %.

16. The method of claim 13, wherein the thermoplastic polymer includes a polyester, a polyimide, or any combination thereof.

17. The method of claim 13, wherein the pinning agent comprises an oxide of at least one of silicon, boron, titanium, zirconium, and a rare earth element, and the reaction products thereof with the polycrystalline alpha alumina matrix.

* * * * *